US007828068B2

(12) United States Patent
Gano et al.

(10) Patent No.: US 7,828,068 B2
(45) Date of Patent: Nov. 9, 2010

(54) SYSTEM AND METHOD FOR THERMAL CHANGE COMPENSATION IN AN ANNULAR ISOLATOR

(75) Inventors: John C. Gano, Carrollton, TX (US); Ralph H. Echols, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 198 days.

(21) Appl. No.: 10/982,267

(22) Filed: Nov. 3, 2004

(65) Prior Publication Data

US 2006/0090903 A1 May 4, 2006
US 2008/0230234 A9 Sep. 25, 2008
US 2009/0277649 A9 Nov. 12, 2009

Related U.S. Application Data

(63) Continuation-in-part of application No. 10/252,621, filed on Sep. 23, 2002, now Pat. No. 6,854,522, and a continuation-in-part of application No. 10/702,830, filed on Nov. 6, 2003, now Pat. No. 7,152,687.

(51) Int. Cl.
*E21B 33/12* (2006.01)

(52) U.S. Cl. ..... 166/387; 166/384; 166/207

(58) Field of Classification Search ..... 166/277, 166/384, 387, 207, 120, 191, 232.2, 187, 166/242.2
See application file for complete search history.

(56) References Cited

U.S. PATENT DOCUMENTS 2,214,226 A 9/1940 English
2,581,070 A * 1/1952 Blood ..... 166/100
3,419,080 A * 12/1968 Lebourg ..... 166/207
3,581,816 A * 6/1971 Malone ..... 166/187
4,349,204 A * 9/1982 Malone ..... 277/334

(Continued)

FOREIGN PATENT DOCUMENTS

GB 2 370 301 6/2002

(Continued)

OTHER PUBLICATIONS

Bentonite as a Sealant. Canadian Clay Products, Inc. Retrieved Jan. 22, 2010, from http://www.canadianclay.com/sealant.htm.*

(Continued)

*Primary Examiner*—Jennifer H Gay
*Assistant Examiner*—Robert E Fuller
(74) *Attorney, Agent, or Firm*—Luke Pedersen

(57) ABSTRACT

In accordance with the teachings of the present invention, a system and method for forming an annular isolator between production tubing and a borehole wall is provided. A section of expandable tubing is installed in a borehole, and a sleeve disposed around a surface of the tubing cooperates with the tubing to form a fluid chamber. The sleeve includes a first portion that is predisposed to expand outwardly under fluid pressure from the fluid chamber, and a second portion that is configured such that, when expanded due to fluid pressure, the second portion stores energy that is biased to sustain the fluid pressure within the chamber, in response to a change in fluid volume. The tubing may be expanded using a tool disposed within the tubing.

24 Claims, 11 Drawing Sheets

U.S. PATENT DOCUMENTS

| | | | | |
|---|---|---|---|---|
| 4,424,861 | A * | 1/1984 | Carter et al. | 277/334 |
| 4,614,346 | A * | 9/1986 | Ito | 277/334 |
| 4,892,144 | A * | 1/1990 | Coone | 277/334 |
| 5,101,908 | A * | 4/1992 | Mody | 166/387 |
| 5,327,962 | A * | 7/1994 | Head | 277/334 |
| 5,398,998 | A | 3/1995 | Evans | 299/21 |
| 6,446,717 | B1 | 9/2002 | White et al. | 166/187 |
| 6,457,518 | B1 * | 10/2002 | Castano-Mears et al. | 166/207 |
| 6,457,533 | B1 | 10/2002 | Metcalfe | 166/381 |
| 6,554,070 | B2 | 4/2003 | Genolet et al. | 166/292 |
| 6,581,682 | B1 | 6/2003 | Parent et al. | 166/180 |
| 6,626,240 | B1 | 9/2003 | Sunde | 166/196 |
| 6,695,067 | B2 | 2/2004 | Johnson et al. | 166/387 |
| 6,725,934 | B2 | 4/2004 | Coronado et al. | 166/313 |
| 6,745,845 | B2 | 6/2004 | Cook et al. | 166/387 |
| 6,779,601 | B2 * | 8/2004 | Wilson et al. | 166/187 |
| 2002/0092654 | A1 | 7/2002 | Coronado et al. | 166/369 |
| 2002/0139540 | A1 | 10/2002 | Lauritzen | 166/387 |
| 2003/0037921 | A1 | 2/2003 | Goodson, Jr. | 166/135 |
| 2003/0116328 | A1 | 6/2003 | Doane et al. | 166/387 |
| 2003/0141079 | A1 | 7/2003 | Doane et al. | 166/387 |
| 2003/0146003 | A1 | 8/2003 | Duggan et al. | 166/387 |
| 2003/0173092 | A1 | 9/2003 | Wilson et al. | 166/387 |
| 2003/0205386 | A1 | 11/2003 | Johnston et al. | 166/382 |
| 2004/0012609 | A1 | 1/2004 | Taneja et al. | 345/611 |
| 2004/0031605 | A1 | 2/2004 | Mickey | 166/179 |
| 2004/0055758 | A1 | 3/2004 | Brezinski et al. | 166/384 |
| 2004/0118572 | A1 | 6/2004 | Whanger et al. | 166/384 |
| 2005/0023003 | A1 | 2/2005 | Echols et al. | 166/384 |
| 2005/0072579 | A1 * | 4/2005 | Gambier | 166/387 |
| 2005/0098324 | A1 * | 5/2005 | Gano | 166/384 |
| 2005/0183864 | A1 * | 8/2005 | Trinder et al. | 166/382 |

FOREIGN PATENT DOCUMENTS

| | | |
|---|---|---|
| GB | 2 371 064 | 7/2002 |
| GB | 2 371 820 | 8/2002 |
| GB | 2 376 486 | 12/2002 |
| GB | 2 380 752 | 4/2003 |
| GB | 2 381 019 | 4/2003 |
| GB | 2 383 361 | 6/2003 |
| GB | 2 384 202 | 7/2003 |
| GB | 2 387 403 | 10/2003 |
| GB | 2 388 136 | 11/2003 |
| GB | 2 396 635 | 6/2004 |
| GB | 2 396 869 | 7/2004 |
| GB | 2 398 313 | 8/2004 |
| GB | 2 398 582 | 8/2004 |
| GB | 2 399 529 A | 9/2004 |
| WO | WO 02/059452 | 8/2002 |
| WO | WO 03/054349 | 7/2003 |
| WO | WO 03/058026 | 7/2003 |
| WO | WO 03/060289 | 7/2003 |
| WO | WO 2004/046500 | 6/2004 |

OTHER PUBLICATIONS

Tsao, Y.H., et al., "A Shear-Thickening Fluid for Stopping Unwanted Flows While Drilling", JPT, vol. 37, Issue 3,. (pp. 499-504), Mar. 1, 1985.

Quinn, David, et al., "Mechanism of a Novel Shear-Sensitive Plugging Fluid to Cure Lost Circulation", SPE International Symposium on Oilfield Chemistry (9 pages), Feb. 16, 1999.

Australian Patent Office Written Opinion; Application No. SG 200703206-3; Application Filing Date: Oct. 3, 2005; Applicant's or agent's file reference: MJ/KLF/ALEX/PAT/8129519/SG, Date of mailing May 15, 2008.

Australian Government Patent Office Examination Report; Application No. SG 200703206-3; Application Filing Date Oct. 3, 2005, Jan. 28, 2009.

* cited by examiner

SYSTEM AND METHOD FOR THERMAL CHANGE COMPENSATION IN AN ANNULAR ISOLATOR

RELATED APPLICATIONS

This application is a continuation-in-part of prior application Ser. No. 10/252,621, filed Sep. 23, 2002, now U.S. Pat. No. 6,854,522. This application is a continuation-in-part of prior application Ser. No. 10/702,830, filed Nov. 6, 2003, now U.S. Pat. No. 7,152,687.

TECHNICAL FIELD OF THE INVENTION

The present invention relates in general to borehole annular isolation systems, and more particularly to a system and method for thermal change compensation in an annular isolator.

BACKGROUND OF THE INVENTION

Oil and gas wells may pass through a number of zones within a formation to reach the particular oil and/or gas zone (s) of interest. Some of the zones through which the well may pass may be water producing. It is desirable to prevent water from these zones from being produced with the produced oil or gas. Where multiple oil and/or gas zones are penetrated by the same borehole, it is also desirable to isolate the zones to allow separate control of production from each zone for the most efficient production. External packers have been used to provide annular seals or barriers between production tubing and well casing to isolate the various zones.

It has become more common to use open hole completions in oil and gas wells. In these wells, standard casing is cemented only into upper portions of the well, but not through the producing zones. Tubing is then run from the bottom of the cased portion of the well down through the various production zones. The various production zones often have different natural pressures and must be isolated from each other to prevent flow between zones and to allow production from relatively low pressure zones.

Open hole completions are particularly useful in slant hole wells. In these wells, the wellbore may be deviated and run horizontally for thousands of feet through a producing zone. It is often desirable to provide annular isolators along the length of the horizontal production tubing to allow selective production from, or isolation of, various portions of the producing zone.

In open hole completions, various steps are usually taken to prevent collapse of the borehole wall and/or the flow of sand from the formation into the production tubing. Gravel packing and sand screens are commonly used to protect against collapse and sand flow. More modern techniques include the use of expandable solid or perforated tubing and/or expandable sand screens. These types of tubular elements may be run into uncased boreholes and expanded after they are in position. Expansion may be by use of an inflatable bladder or by pulling or pushing an expansion cone through the tubular members. It is desirable for expanded tubing and screens to minimize the annulus between the tubular elements and the borehole wall or to actually contact the borehole wall to provide mechanical support and restrict or prevent annular flow of fluids outside the production tubing. However, in many cases, due to irregularities in the borehole wall or simply unconsolidated formations, expanded tubing and screens will not prevent annular flow in the borehole. For this reason, annular isolators are often needed to stop annular flow.

Use of conventional external casing packers for such open hole completions presents a number of problems. They are significantly less reliable than internal casing packers, they may require an additional trip to set a plug for cement diversion into the packer, and they are not compatible with expandable completion screens.

Efforts have been made to form annular isolators in open hole completions by placing a rubber sleeve on expandable tubing and screens and then expanding the tubing to press the rubber sleeve into contact with the borehole wall. These efforts have had limited success due primarily to the variable and unknown actual borehole shape and diameter. The thickness of the sleeve must be limited since it adds to the overall tubing diameter, which must be limited to allow the tubing to be run into the borehole. The maximum size must also be limited to allow tubing to be expanded in a nominal or even undersized borehole. In washed out or oversized boreholes, normal tubing expansion is not likely to expand the rubber sleeve enough to contact the borehole wall and form a seal. To form an annular seal or isolator in variable sized boreholes, adjustable or variable expansion tools have been used with some success. However it is difficult to achieve significant stress in the rubber with such variable tools and this type of expansion produces an inner surface of the tubing which follows the shape of the borehole and is not of substantially constant diameter.

Some isolators rely upon pressurized fluid to actuate the isolator to its expanded position. Temperature changes experienced downhole can impact the effectiveness of such isolators due to changes in pressure and volume, that may accompany dramatic changes in temperature. Changes in temperature may have an even greater impact in systems in which the material used to encase the fluid has a significantly different coefficient of thermal expansion than the fluid that it encases, since temperature changes may cause a change in volume and/or pressure of the encased fluid.

SUMMARY OF THE INVENTION

The teachings of the present invention provide a system and method for thermal change compensation in an annular isolator. In accordance with a particular embodiment, the system includes a section of generally cylindrical tubing having a sleeve disposed around a surface of the tubing. The sleeve cooperates with the tubing to form a fluid chamber. The sleeve includes a first portion that is predisposed to expand outwardly under fluid pressure from the fluid chamber, and a second portion being configured such that, when expanded due to fluid pressure, the second portion stores energy that is biased to sustain the fluid pressure within the chamber, in response to a change in fluid volume.

In accordance with one embodiment, the second portion of the sleeve may comprise an at least partially corrugated region. The corrugated region may include longitudinal corrugations at particular locations along the circumference of the sleeve. When the corrugated region is expanded, the corrugations are biased toward the tubing. Therefore, any decrease in pressure within the chamber will cause the corrugations to move toward the tubing, thereby tending to reduce the volume of the chamber to compensate for the decrease in pressure.

In accordance with another embodiment, the second portion of the sleeve may include a plurality of radialy elastic members disposed between the tubing and the sleeve, to increase the elastic response of the second portion of the sleeve. Thus, the radialy elastic members will be compressed when the tubing is expanded, and the sleeve will be biased to sustain the fluid pressure within the chamber, in response to a change in fluid volume.

Depending on the specific features implemented, particular embodiments of the present invention may exhibit some, none, or all of the following technical advantages. A technical advantage may be that an expandable sleeve may provide a compliant chamber in which a flowable material may be used to expand the sleeve and form an annular seal with a borehole wall. Another technical advantage may be that the inflatable sleeve may have certain characteristics that allow an annular seal to be formed in an oversized, washed out, and/or irregular shaped borehole. The flexibility of the inflatable sleeve may allow it to conform to such irregular shapes so long as it does not exceed the maximum allowable expansion of the sleeve.

As still another advantage, the expandable sleeve may include at least one corrugated portion that compensates for volumetric and/or pressure changes caused by temperature changes, to substantially maintain the annular seal, even during variable temperature and/or pressure conditions. Specifically, during high pressure conditions, the corrugated portion may become slightly deformed to account for a greater volume and/or pressure of fluid in the compliant chamber. The corrugated portion may be biased to return to substantially its original shape or to something resembling its original shape, however, when the temperature, pressure and/or volume in the compliant chamber decreases. Accordingly, a further technical advantage may be that the annular seal between the expanded sleeve and the borehole wall may be maintained, even during reduced temperature and/or reduced pressure conditions.

Other technical advantages will be readily apparent to one skilled in the art from the following figures, descriptions and claims. Moreover, while specific advantages have been enumerated above, various embodiments may include all, some or none of the enumerated advantages.

DETAILED DESCRIPTION OF THE INVENTION

Figure 1:
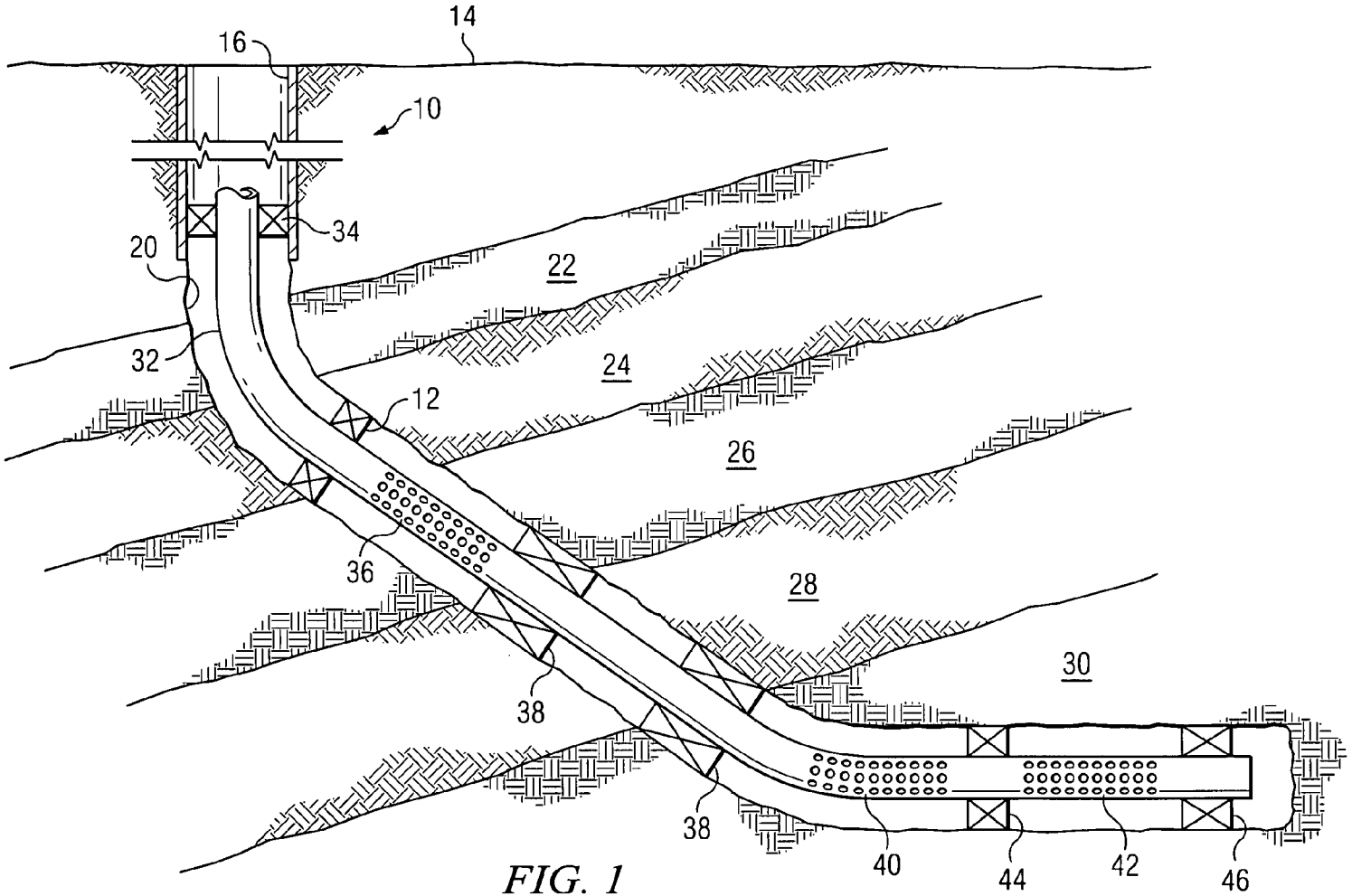
FIG. 1 illustrates a cross-sectional view of a borehole with an open hole completion and a number of annular isolators in accordance with a particular embodiment of the present invention.

FIG. 1 is a cross-sectional view of a borehole 10 with an open hole completion and a number of annular isolators 12. For purposes of this document, an "annular isolator" is a material or mechanism or a combination of materials and mechanisms which minimize or prevent the flow of fluids from one side of the isolator to the other, in the annulus between a tubular member in a well and a borehole wall or casing. An annular isolator acts as a pressure bearing seal between two portions of the annulus. Since annular isolators must block flow in the annular space, they may have a ring like or tubular shape having an inner diameter in fluid tight contact with the outer surface of a tubular member and having an outer diameter in fluid tight contact with the wall of a borehole or casing. An annular isolator may extend for a substantial length along a borehole.

In accordance with the teachings of the present invention, an annular isolator is provided in which an expandable sleeve is actuated by fluid pressure exerted from a chamber between the sleeve and expandable tubing, and is used to form the annular isolator. The sleeve, and therefore the annular isolator, also incorporates features that accommodate significant changes in temperature, while maintaining a fluid tight seal between the tubing and the borehole wall. These features will be described later, in more detail.

In FIG. 1, borehole 10 has been drilled from the surface of the earth 14. An upper portion of the borehole 10 has been lined with casing 16 which has been sealed to the borehole 10 by cement. Below the cased portion of borehole 10 is an open hole portion 20 which extends downward and then laterally through various earth formations. For example, in the illustrated embodiment, open hole portion 20 of borehole 10 passes through a water bearing zone 22, a shale layer 24, a first oil bearing zone 26, and a nonproductive zone 28 and passes into a second oil bearing zone 30. Open hole portion 20 has been slanted so that it runs through zones 22-30 at various angles. For example, open hole portion 20 is substantially horizontal through oil-bearing zone 30. Slant hole or horizontal drilling technology allows such wells to be drilled for thousands of feet away horizontally from the surface location of a well and allows a well to be guided to stay within a single zone if desired. Wells following an oil bearing zone will seldom be exactly horizontal, however, since oil bearing zones are normally not horizontal. Thus, open hole portion 20 that runs through zone 30 is said to be substantially horizontal.

Tubing 32 has been placed to run from the lower end of casing 16 down through open hole portion 20 of the well. At its upper end, tubing 32 is sealed to casing 16 by a first annular isolator 34. A second annular isolator 12 seals the annulus between tubing 32 and the wall of open borehole 20 within shale zone 24. It can be seen that isolators 34 and 12 operate to prevent the annular flow of fluid from water-producing zone 22 and thereby prevent production of water from zone 22.

Within oil zone 26, tubing 32 has a perforated section 36. Perforated section 36 may be a perforated liner and may typically carry sand screens or filters about its outer circumference. The term "perforated" as used in this document (e.g., perforated tubing or perforated liner) means that the member has holes or openings through it. The holes may be round, rectangular, slotted, or of any other suitable shape. "Perforated" is not intended to limit the manner in which the holes are made. For example, "perforated" does not require that the holes be made by perforating and does not limit the arrangement of the holes.

A pair of annular isolators 38 prevents annular flow to, from, or through nonproductive zone 28. Isolators 38 may be a single isolator extending completely through nonproductive zone 28 if desired. In the illustrated embodiment, however, the combination of second isolator 12 and the up-hole isolator 38 allows production from oil zone 26 into perforated tubing section 36 to be selectively controlled and prevents the produced fluids from flowing through the annulus to other parts of open borehole 20.

Within oil zone 30, tubing 32 is illustrated as having two perforated sections 40 and 42. Sections 40 and 42 are perforated and may have sand screens or filters disposed about the outer circumference of sections 40 and 42. A second pair of annular isolators 44 and 46 are provided to seal the annulus between tubing 32 and the wall of open borehole 20 within second oil zone 30. In an alternative embodiment, tubing 32 may be plugged at its downhole end, in which case isolator 46 would not be required. Annular isolators 38, 44, and 46 allow separate control of flow of oil into perforated sections 40 and 42 and prevent annular flow of produced fluids to other portions of open borehole 20. As described above, the horizontal section of open hole 20 may continue for thousands of feet through the oil bearing zone 30. Tubing 32 may likewise extend for thousands of feet within oil zone 30 and may include numerous perforated sections which may be divided by numerous annular isolators, such as isolators 44 and 46, to divide oil zone 30 into multiple areas for controlled production.

In particular embodiments, tubing 32 may include expandable tubular sections. Both the solid sections of tubing 32 and perforated sections 40 and 42 may be expandable. Depending on the types of expansion required, a fixed expansion cone and/or a variable diameter expansion cone may be used to expand tubing 32. The fixed expansion cone may be carried on an expansion tool string and may be used to expand the entire tubing string as the tool is run down the borehole. Where additional expansion is desired at particular locations in tubing 32, an adjustable cone may be carried on the expansion tool string in addition to the fixed cone. Alternatively, an adjustable cone may be carried down hole with tubing 32 as tubing 32 is installed and picked up by the expansion tool when the cone reaches the end of tubing 32.

The use of expandable tubing 32 provides numerous advantages. For example, expandable tubing 32 is of reduced diameter during installation, which facilitates installation in offset, slanted, or horizontal boreholes. Upon expansion, solid or perforated tubing 32 and screens provide support for uncased borehole walls while screening and filtering out sand and other produced solid materials which can damage tubing 32. After expansion, the internal diameter of tubing 32 is increased improving the flow of fluids through tubing 32.

It is desirable for expandable tubing 32 to reduce the annulus between tubing 32 and the borehole wall as much as possible. The tubing may be expanded only a limited amount, however, without rupturing. It is therefore desirable for tubing 32 to have the largest possible diameter in its unexpanded condition as tubing 32 is run into the borehole. That is, the larger tubing 32 is before expansion, the larger tubing 32 may be after expansion. Elements carried on the surface of tubing 32 as it is run into a borehole increase the outer diameter of the string. The total outer diameter must be sized to allow the string to be run into the borehole. The total diameter is the sum of the diameter of the actual tubing 32 plus the thickness or radial dimension of any external elements. Thus, external elements effectively reduce the allowable diameter of the actual expandable tubing 32.

Since there are limits to which expandable tubing 32 may be expanded and the borehole walls are typically irregular and may actually change shape during production, annular flow cannot be prevented merely by the use of expandable tubing 32, including expandable perforated sections and screens 40 and 42. To achieve the desirable flow control, annular barriers or isolators 44 and 46 are needed. Typical annular isolators such as inflatable packers, however, have not been found compatible with the type of production installation illustrated in FIG. 1 for various reasons, including the fact that the structural members required to mount and operate such packers are not expandable along with the tubing string.

The annular isolators included in prior systems have typically included thin rubber sleeves on the outside of expandable screens and/or tubing. The sleeves may extend for substantial distances along the axial length of the tubing. Even after the tubing is expanded such sleeves may not make contact with the wider portions of the borehole and, thus, may not form an effective annular isolator. As a further problem, in thin portions of the borehole, these prior sleeves may contact the borehole wall before the expandable tubing is fully expanded creating excessive forces in the expansion process. Due to their axial length, the forces required to extrude or flow such sleeves axially in the annulus cannot be generated by an expansion tool and, if they could, would damage the borehole or the tubing.

Another type of annular isolator used in prior systems includes a ring or band of elastomeric material, such as rubber, carried on the outer surface of the tubing. As compared to the annular isolators described above, the ring or band may have a fairly short axial dimension (its length along the axial length of the tubing), but have a relatively long radial dimension (the distance it extends from the tubing in the radial direction towards the borehole wall). The rings are preferably tapered to have a longer axial dimension where bonded to the outer surface of the tubing and shorter axial dimension on the end which first contacts the borehole wall. A pair of such rings separated by a continuous sleeve of elastomer may form a single annular isolator such as isolator 44 in FIG. 1. During the expansion process, the tubing is expanded to a larger diameter and a ring or band such as that described above may be forced into contact with the borehole wall. Expansion of the tubing reduces the radial dimension and increases the axial dimension of the rings or bands.

Another type of annular isolator includes a sleeve, or jacket, disposed around the outer diameter of a portion of the tubing. The area between the sleeve and the tubing may form a compliant chamber that is at least partially filled with a fluid or other pressurized material. As will be described in more detail below, the sleeve may include a weakened portion that may be expanded using the fluid in the compliant chamber. The combination of the expanded sleeve and the fluid may form an annular isolator that operates to separate two zones or sections within a zone of a formation. Temperature changes caused by the injection of fluids during production, however, may cause a decrease in the pressure and/or volume of the fluid in the compliant chamber. As a result, the seal between the jacket and the borehole wall may be broken and the annular isolator may be ineffective for preventing water and other undesirable fluids and particulate from being produced with the desired hydrocarbons.

Figure 2:
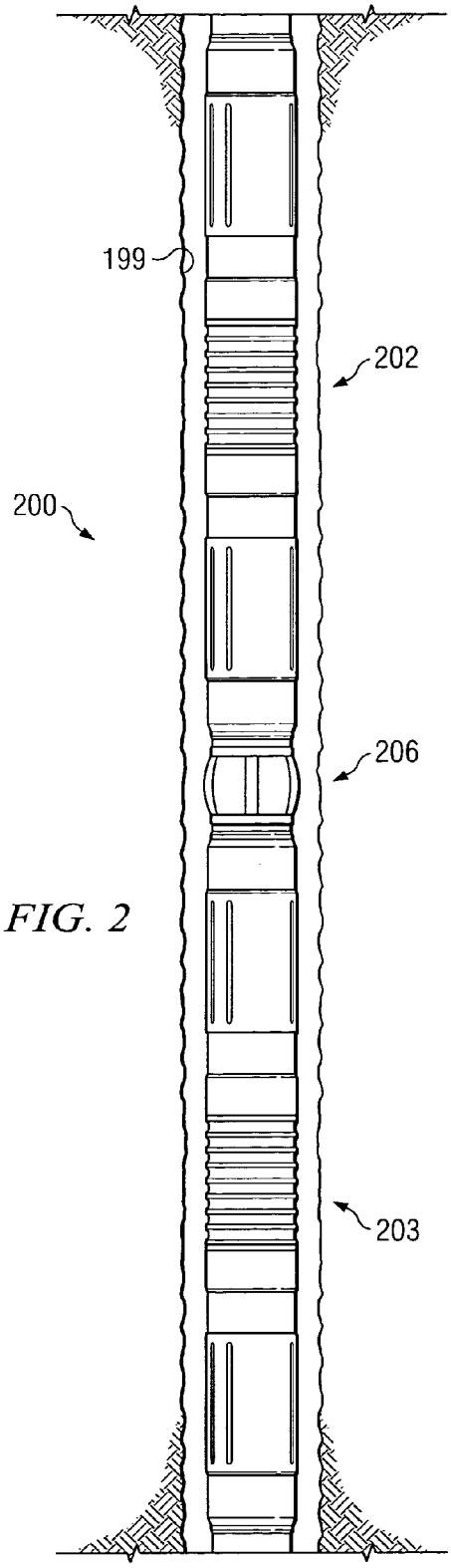
FIG. 2 illustrates a cross-sectional view of an annular isolation system suitable for use within the teachings of the present invention.
Figure 3:
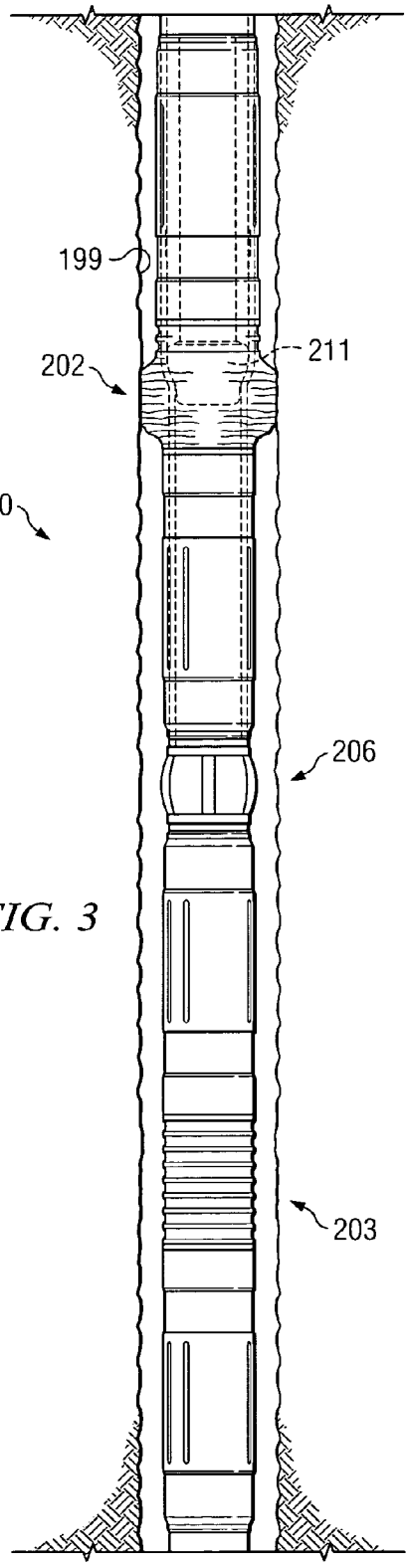
FIG. 3 illustrates a cross-sectional view of the annular isolation system of FIG. 2, in a partially expanded position.

FIGS. 2 and 3 illustrate an annular isolation assembly 200 that may be used to accomplish annular isolation of production zones, as described above. Annular isolation assembly 200 includes two annular isolators 202 and 203, having a centralizer 206 disposed therebetween. Each of annular isolators 202 and 203 may be actuated to expand and seal the annulus 197 between tubing 204 and borehole wall 199. In FIG. 2, annular isolators 202 and 203 are each in an initial, installed position. In FIG. 3, annular isolator 202 is illustrated in an expanded position.

The actuation of annular isolators 202 and 203 is accomplished by causing fluid pressure to expand a central region of the respective annular isolator. Moreover, each of annular isolators 202 and 203 have been modified to accommodate substantial changes in temperature, while maintaining an adequate seal between tubing 204 and borehole wall 199. Since the configuration and operation of annular isolators 202 and 203 are very similar, the description below will focus upon annular isolator 202. However, it will be recognized by those having ordinary skill in this art, that all of the components, features, modifications, alternatives and/or advantages discussed with regard to annular isolator 202 may be applied to annular isolator 203, as well.

Although the illustrated embodiment includes two annular isolators having a centralizer disposed therebetween, it should be recognized that these, and various other components may be modified, omitted or relocated within the teachings of the present invention. For example annular isolator 203 and/or centralizer 206 could be omitted from annular isolation assembly 200, and annular isolation assembly 200 could still be used to seal the annulus between tubing 204 and sleeve 205 (shown in detail in FIGS. 4A-4C). Furthermore, more than two annular isolators could be provided upon a particular annular isolation system, if design consideration so warranted. Centralizers may be placed between annular isolators, or two centralizers could be provided on either side of one or more annular isolators.

Centralizer 206 functions to protect other components of annular isolation assembly 200 during installation and retrieval, through the borehole. Accordingly, centralizer 206 is disposed around the exterior of tubing 204, and extends outwardly therefrom. Centralizer 206 is provided with a sufficient exterior diameter to extend radialy outward slightly beyond annular isolators 202 and 203, when annular isolators 202 and 203 are in their respective unactuated positions. This serves to protect annular isolators 202 and 203 from contact with the borehole wall and/or other debris, during installation and retrieval. Moreover, centralizer 206 tends to "center" annular isolator assembly within the borehole, to prevent significant friction with the casing and/or borehole wall, and to prevent annular isolator assembly 200 from becoming lodged within the casing and/or borehole.

Although a single annular isolation assembly 200 is illustrated in each of FIGS. 2 and 3, it is generally recognized that a tubing string may include any appropriate number of annular isolation assemblies 200. Each annular isolation assembly 200 may expand at different pressures and may or may not include pressure relief valves. Where desired, pressure relief valves may protect the system from excessive pressure. The combinations of these elements provides for maximum inflation to form one or more annular isolators in a large irregular borehole, while allowing the same system to be inflated to form an annular isolator in a nominal or undersized borehole without causing excessive pressures or forces which may damage the annular isolator forming sleeve, ring, etc., the tubing or an expansion tool.

Figure 4A:
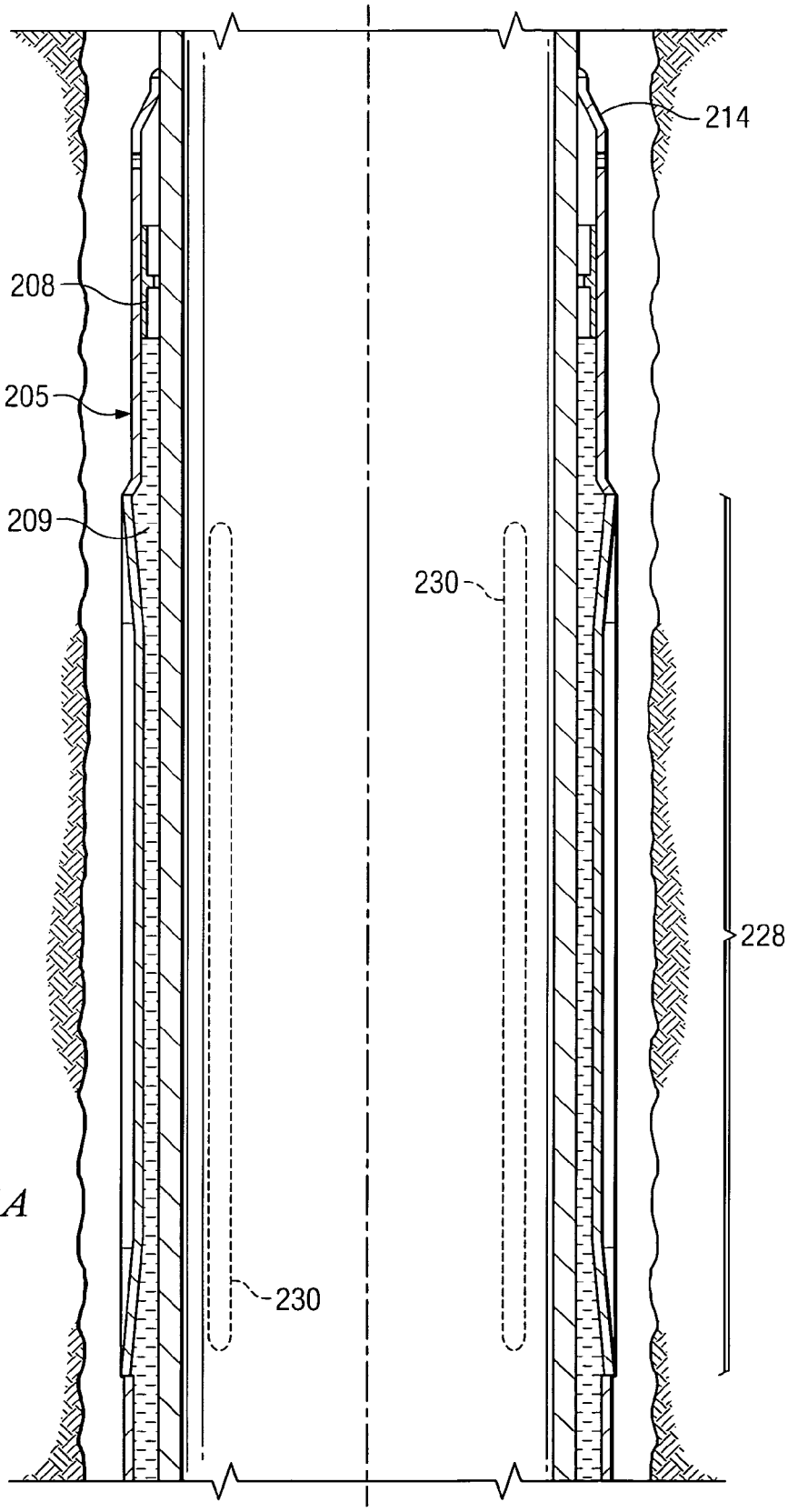
FIGS. 4A-4C illustrate one annular isolator, of the annular isolation system of FIGS. 2 and 3.
Figure 4B:
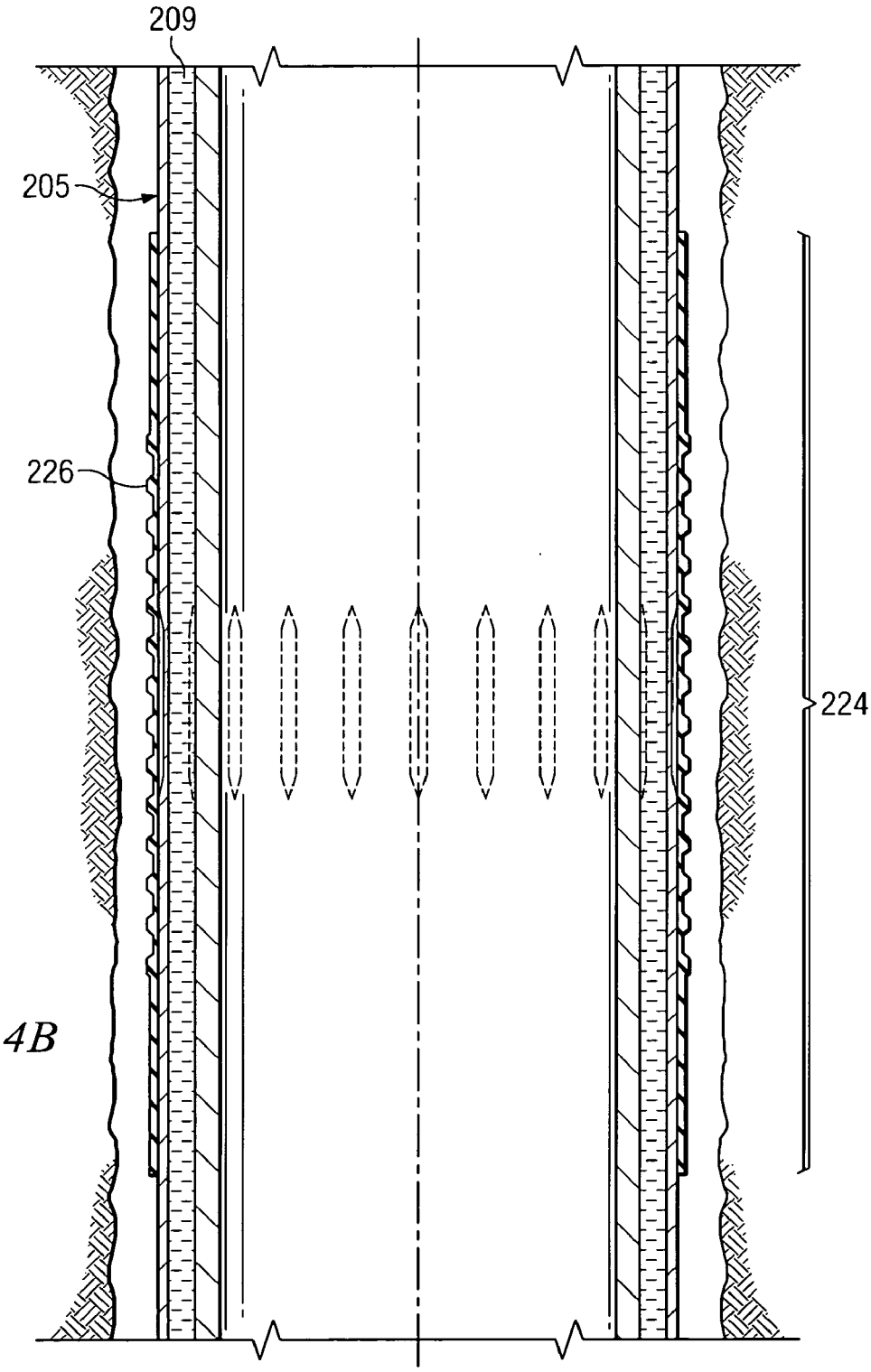
Figure 4C:
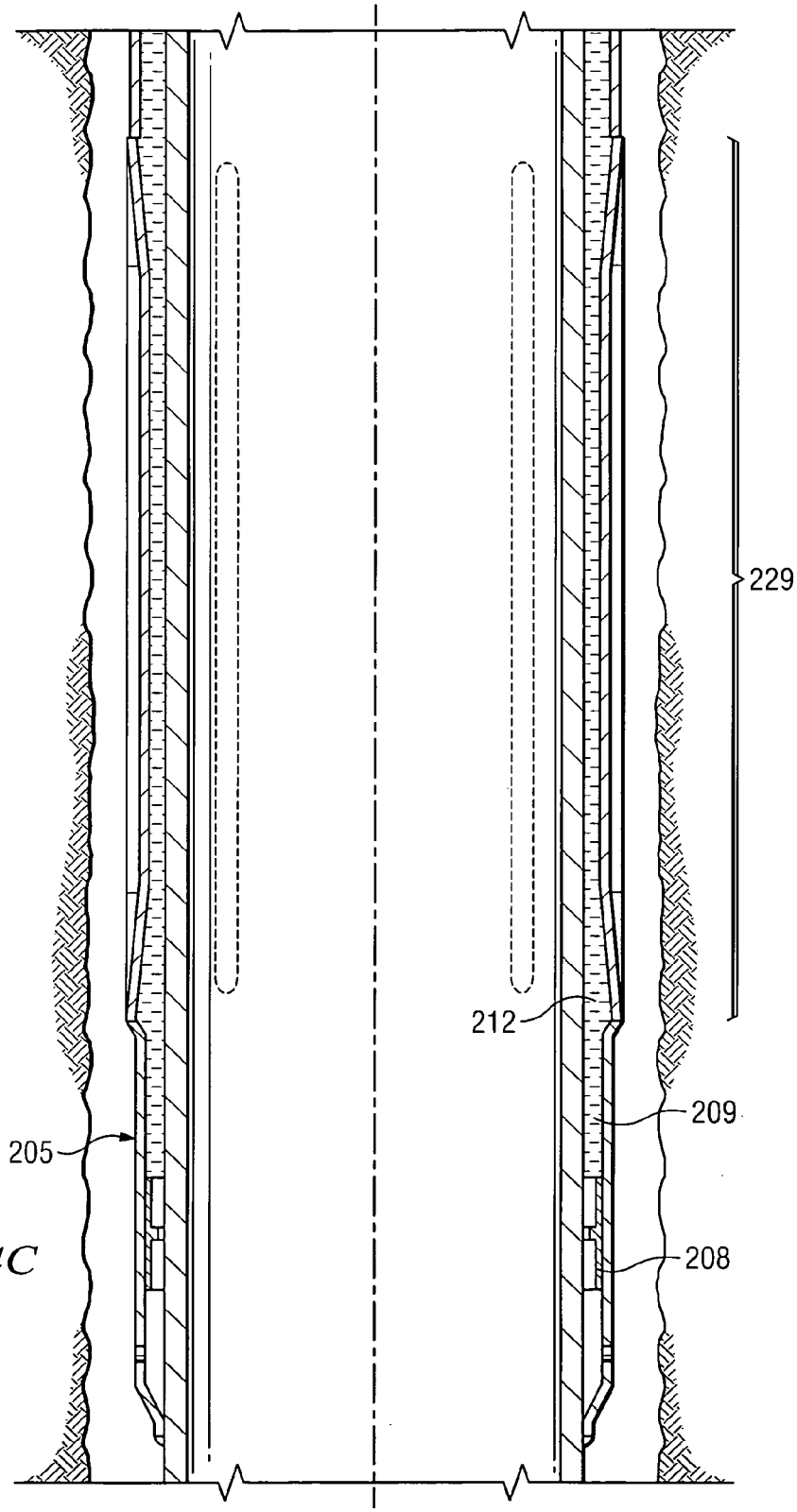

FIGS. 4A-4C illustrate annular isolator 202 in more detail. Annular isolator 202 includes an elongate, longitudinal sleeve 205 that is installed around the circumference of tubing 204, and forms a fluid chamber 209, between tubing 204 and sleeve 205. Fluid chamber 209 extends between and is defined, at least in part, by a pair of elastomeric relief valves 208. Relief valves 208 help to contain a material (e.g., fluid) within fluid chamber 209, but also allow for the selective and partial release of fluid from chamber 209, to alleviate excessive pressure therein. Fluid chamber 209 may also be referred to herein as a "compliant chamber."

A portion of sleeve 205 is intentionally weakened, to allow for greater expansion of that portion, with respect to the other portions of sleeve 205. Thus, when fluid 212 is under pressure, a weakened portion 224 will "fail" or expand first, and bulge out toward the borehole wall. A thin walled, metal sheath at this portion is expandable, or "inflatable" under fluid pressure.

In particular embodiments, the annular isolation assembly 200 illustrated in FIGS. 2-4C may be installed in lieu of isolators 12, 38, 44 and/or 46 of FIG. 1. Accordingly, annular isolation assembly 200 may form any portion of tubing where it is desirable to form an annular seal between two zone formations or between two sections within a single zone formation.

Sleeve 205 as installed has an inner diameter that is greater than the outer diameter of expandable tubing 204 to increase the amount of fluid 212 which may be carried down hole with expandable tubing 204. Sleeve 205 is bonded by welding or otherwise to expandable tubing 204 at an up hole end 214. Sleeve 205 may be referred to as a "metal" sleeve, sheath, or jacket primarily to distinguish from elastomeric materials. Sleeve 205 may be formed of any metallic like substance such as ductile iron, stainless steel (e.g., 316L) or other alloys, or a composite including a polymer matrix composite or metal matrix composite.

The fluid chamber 209 formed by sleeve 205 and tubing 204 is filled with a fluid 212, which may be any type of liquid, gas, or liquid like solid that inflates sleeve 205 to form an annular isolator against the borehole wall. In particular embodiments, fluid 212 may include chemical systems which react with ambient fluids to become viscous, semisolid or solid. Fluid 212 may also include flowable solid materials such a glass beads.

In another embodiment, fluid 212 may include very small spheres, for example ceramic beads. The beads may be coated with a fluid to reduce friction. In this embodiment, the beads would exhibit fluid-like behavior, but would expand and contract more closely to the rate of the tubing and the sleeve, since the thermal expansion coefficient would likely be closer to that of a metal.

In still another ebmodiment, fluid 212 may be a sealant and/or a fluid that changes state to a solid or semi-solid. In this embodiment, force could be transmitted through the solid or semi-solid within the fluid chamber, if the solid and/or semi-solid were sufficiently elastic.

The weakened portion 224 of outer sleeve 205 is predisposed to expand at a lower pressure than the remaining portion of sleeve 205. Weakened portion 224 may be made of a different material or may be treated to expand at lower pressure. For example, weakened portion 224 may be notched, perforated, or heat-treated, e.g. annealed, before assembly such that reduced pressure, or force is needed to inflate weakened portion 224 when fluid 212 becomes pressurized. In particular embodiments, weakened portion 224 may comprise corrugated pipe. The corrugations may encompass the full circumference of weakened portion 224 such that sleeve 205 remains expanded after the expansion process.

For the purposes of the present invention, "weakened portion" refers to a portion of the sleeve that is predisposed to expand more readily than other portions of the sleeve. It is not intended to mean that the weakened portion is necessarily processed in some manner to weaken it. Although various methods are available to weaken a section of the metallic sleeve, the weakened portion may be provided as an unprocessed thin-walled material or sheath, that is more likely to expand than other portions of the sleeve. The weakened portion may or may not be comprised of the same material as other portions of the sleeve.

Figure 5A:
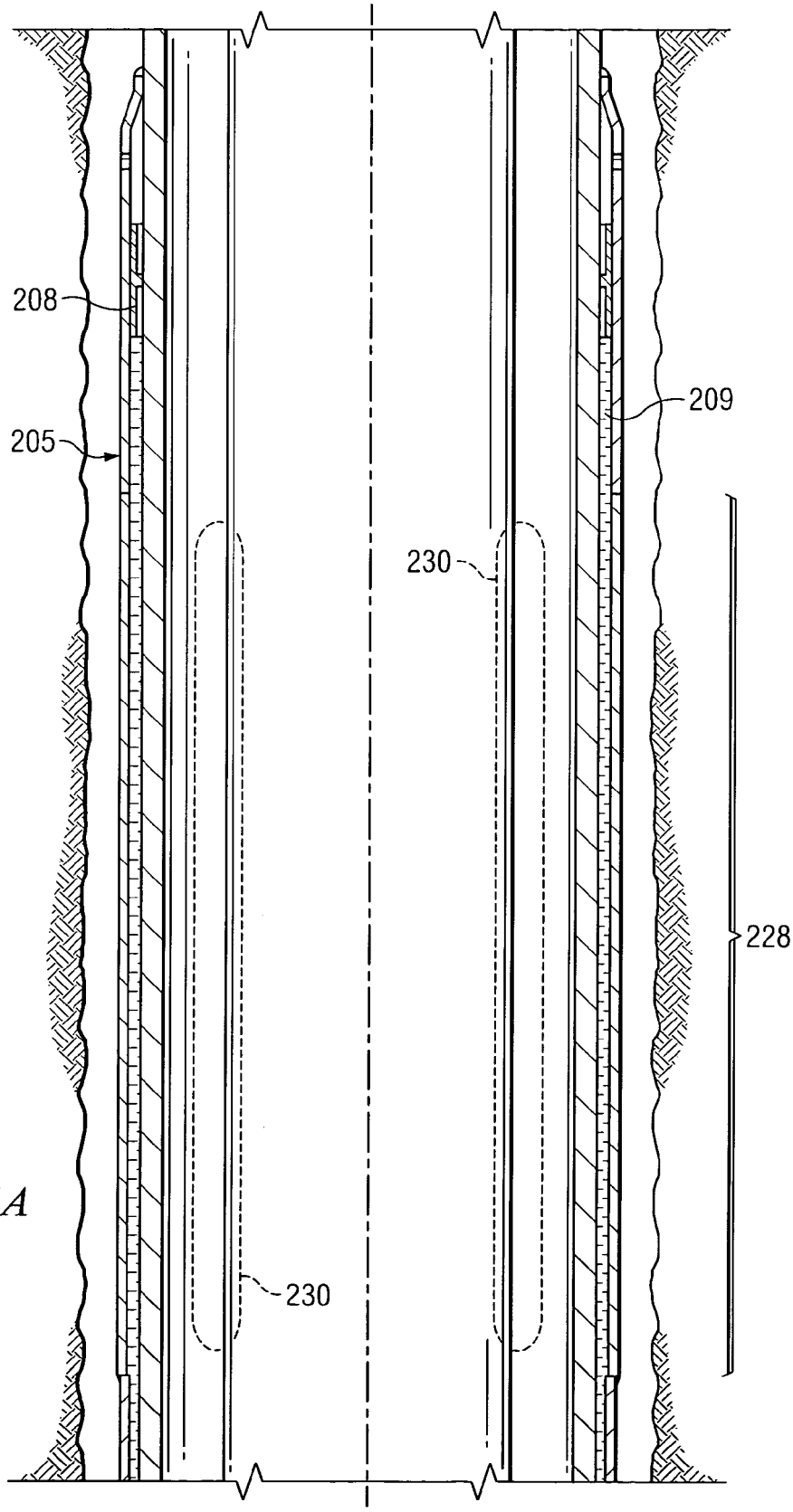
FIGS. 5A-5C illustrate the annular isolator of FIGS. 4A-4C, in an expanded position.
Figure 5B:
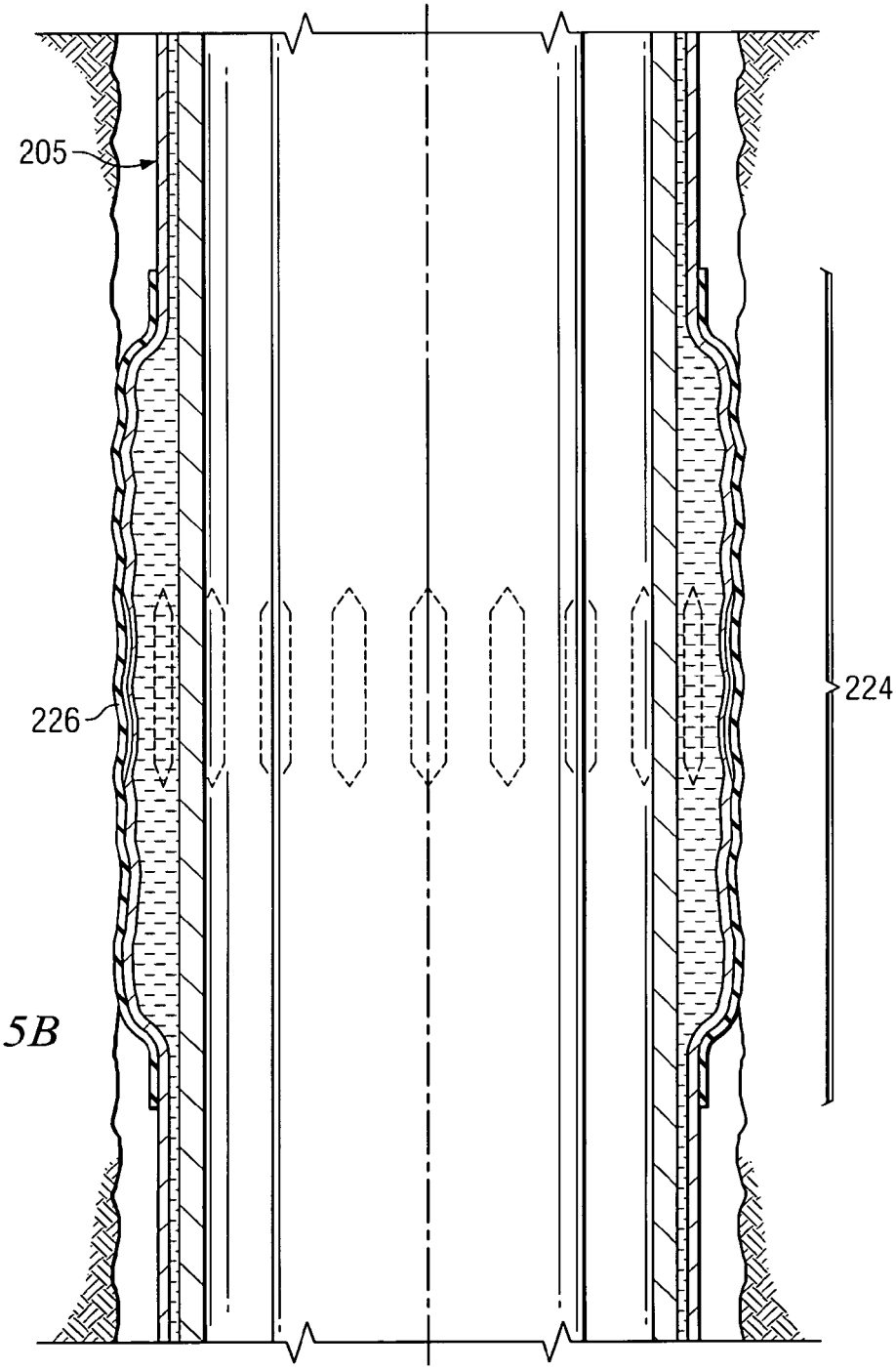
Figure 5C:
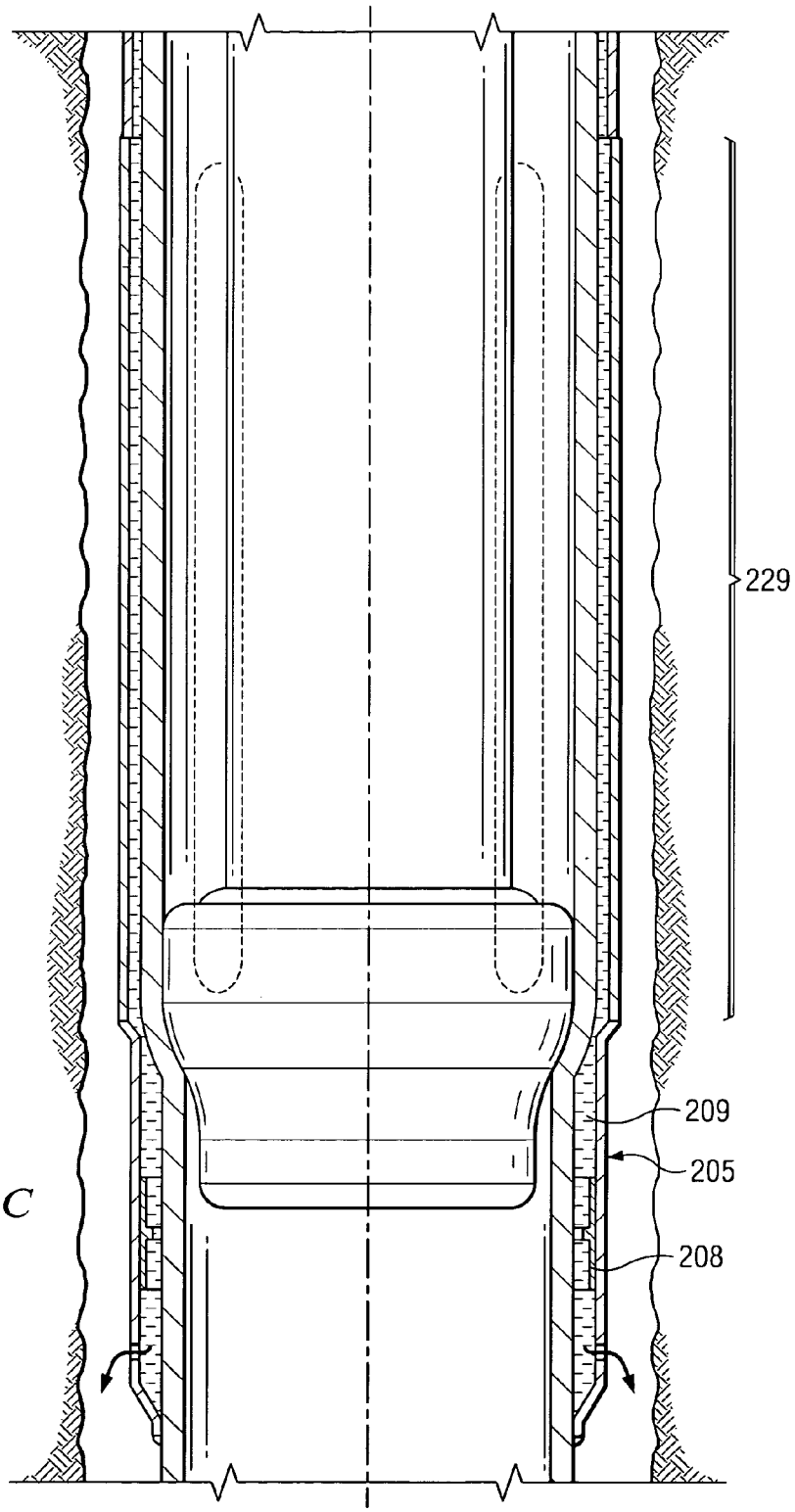

FIGS. 5A-5C illustrate annular isolator 202 in an expanded position. FIG. 5B illustrates weakened portion 224 in its "inflated", or expanded position.

Sleeve 205 may be covered by an elastomeric sleeve or layer 226 on its outer surface. Elastomeric sleeve 226 is particularly beneficial on weakened portion 224. (See FIGS. 4B and 5B.) For example, if weakened portion 224 is corrugated, elastomeric sleeve 226 will help form a seal with a borehole wall in case the corrugations are not completely removed during the expansion process. Elastomeric sleeve 226 would also be beneficial on any portion of the sleeve 205 which is perforated.

Elastomeric sleeve 226 is optionally provided to protect weakended portion 224 from the environmental elements of the wellbore. Weakened portion 224 is typically thin-walled and expandable, and is susceptible to damage due to contact with the wall of the borehole, or other debris present in the wellbore. Sharp or sturdy objects could therefore puncture or damage weakened portion 224, and elastomeric sleeve 226 helps to minimize the exposure of weakened portion 224 to such hazards.

In operation, annular isolation assembly 200 is run into a wellbore in the unexpanded condition illustrated in FIGS. 2 and 4A-4C. The tubing may be provided in one or more of various sizes. In the illustrated embodiment, it is contemplated that the tubing will be provided with a 7" outer diameter and may be expanded to a diameter of 8.03". Once properly positioned, an expander cone 211 (See FIG. 3) is forced downhole through tubing 204. (From top to bottom on FIGS. 4A-4C.) As the expander cone 211 is pushed through the portion of tubing 204 that is enshrouded by annular isolator 202, sleeve 205 expands along with tubing 204. Additionally, the pressure of fluid 212 in fluid chamber 209 is increased. Specifically, as the cone passes through the portion of tubing 204 that is surrounded by corrugated portion 228, the pressure of fluid 212 adjacent the corrugations increases. The increase in pressure causes the corrugations of sleeve 205 to become slightly deformed such that corrugated portion 228 bulges slightly (see FIG. 5A). The expander cone 211 also causes a portion of the fluid 212 in the corrugated portion 228 of fluid chamber 209 originally stored adjacent corrugated portion 228 to be swept, or squeezed toward weakened portion 224.

Since the fluid is forced downhole toward weakened portion 224, it is anticipated that the majority of the fluid in chamber 209 will initially be stored uphole from weakened portion 224. Therefore, it may be beneficial to design the fluid chamber 209 such that the volume of the chamber uphole from weakened portion 224 is substantially greater than the portion of the chamber located downhole from weakened portion 224. In the illustrated embodiment, it is envisioned that the fluid chamber 209 will store approximately 5 $in^3$/inch of length. However, this value may be adjusted substantially within the teachings of the present invention. Moreover, it may be desirable to design the annular isolator such that more fluid is stored per inch of length uphole from weakened portion 224 than is stored downhole from weakened portion 224.

As the expander cone 211 passes through weakened portion 224, the pressure of fluid 212 is further increased. Because weakened portion 224 has a predisposition to expand when the pressure in fluid chamber 209 increases, the weakened portion expands, or "inflates" outwardly towards the borehole wall. Inflation begins with weakened portion 224 which inflates at a first pressure level. When weakened portion 224 contacts the borehole wall, the pressure of fluid 212 increases until a second pressure level is reached at which other portions of outer sleeve 205 may begin to inflate. If proper dimensions have been selected, the weakened portion 224 and elastomeric layer 226 will be pressed into conforming contact with the borehole wall. To ensure that such contact is made, it is desirable to have an excess of fluid 212 available. If there is excess fluid 212 and outer sleeve 205 makes firm contact with an outer borehole wall at its weakened portion 224, the expansion process will raise the pressure of fluid 212 to a third level at which one or both of the pressure relief valves 208 may open and release excess fluid 212. The excess fluid 212 may then flow through the lower pressure relief valve 208 into the annular space between tubing 204 and a borehole wall.

In the illustrated embodiment, pressure relief valves are formed by crimping sleeve 205 over tubing 204 with an elastomeric sleeve disposed therebetween. The elastomeric sleeve is therefore compressed, and functions to provide a fluid tight seal between the sleeve and the tubing. However, the design also allows for the release of fluid from the chamber if the fluid reaches a predetermined, maximum value. It will be recognized that there are various ways known in the art to provide pressure relief functionality to the seal between the sleeve and the tubing.

If there were no pressure relief mechanism, such as pressure relief valves 208, excessive pressure could occur in fluid 212 during expansion and the expansion tool, tubing, and/or borehole wall could experience excessive forces. The result could be collapse of tubing 204, rupture of tubing 205 (e.g., at weakened portion 224), and/or or stoppage or breakage of the expansion tool. Pressure relief valves 208 release excess fluid 212 into the annulus to avoid excess pressures and forces.

The pressure relief valves are configured to release fluid from the fluid chamber during expansion of the expansion tubing, and then hold a particular pressure afterwards. In accordance with a particular embodiment of the present invention, the pressure relief valve may be designed to release fluid from the fluid chamber when the pressure reaches 1,500 psi prior to expansion and 2,000 psi after expansion of the expandable tubing.

In accordance with another embodiment of the present invention, excess fluid that is intended to be discharged from the fluid chamber may be used as a sealant. Various fluids are known in the art that become very viscous, semi-solid and/or solid, to prevent the flow of fluid through the annulus.

Annular isolator 202 exhibits several functional features and advantages. For example, the corrugations of corrugated portion 228 of sleeve 205 have spring like qualities that compensate for volumetric and/or pressure changes caused by temperature changes in fluid chamber 209. During production operations, fluids may be pumped down tubing string 204 for any of a variety of reasons that are well known in the art. Often these fluids are inserted into the borehole at ambient temperatures that correspond with the surface. The temperature of the fluids may operate to substantially cool the surface of tubing 204, the annular isolator 202, and fluid 212 in chamber 209. The temperature change may cause the internal pressure and/or volume of fluid 212 to decrease. The end result may be that the annular seal formed by weakened portion 224 is broken, as weakened portion 224 retracts away from the borehole wall due to the reduced pressure. As an example, such a temperature change may result if fluid at 90° F. is pumped into a well having an ambient temperature of approximately 250° F.

The decrease in pressure is caused, at least in part, due to the change in volume of fluid 212 as it relates to the change in volume of chamber 209. Most fluids have a higher coefficient of thermal expansion than metal, and therefore, will contract faster than metal when subject to decreased temperature. Therefore, the volume of fluid within the chamber will contract faster than the chamber itself, and cause a decrease in the pressure caused by the fluid. Furthermore, since the rate of thermal of expansion of the material that forms that borehole wall may also be significantly different than the respective coefficients of the metal and fluid, temperature changes can impact the size of the annulus, and therefore, the quality of the seal provided by the annular isolator.

In the illustrated embodiment of FIGS. 4A-4C and 5A-5C, a second corrugated portion 229 is provided (See FIGS. 4C and 5C, specifically) that functions similarly to corrugated portion 228. In this embodiment, however, the second corrugated portion 229 is located downhole from weakened portion 224. It should be recognized that corrugated portion 229 is optional, and a single corrugated portion 228 may be provided within the teachings of the present invention. Moreover, the location of the corrugated portion may be uphole, or downhole from weakened portion 224, and remain within the teachings of the present invention.

The combination of corrugated portion 228 and 229 cooperate to function as a pressure regulator, with fluid chamber 209. Thus, force and/or pressure exerted upon corrugated portion 228 from the annulus, can be transferred through fluid 212 to corrugated portion 229, to minimize the threat that overpressure of the annulus uphole from corrugated portion 228 will result in failure of the seal between sleeve 205 and the borehole wall. Moreover, corrugated portion 229 may be designed to "absorb" high pressure within fluid chamber 209 through plastic deformation. This compensates for high pressure within fluid chamber 209 caused by high temperature and/or pressure of fluid 212, expansion of the annular isolator toward the borehole wall, shrinkage or partial collapse of the borehole wall, and/or many other factors.

The amount of fluid pressure that's trapped in the fluid chamber will also depend, at least in part, upon the speed with which the expandable tubing is expanded. The amount of pressure that corrugated portion 229 can handle during operation is based upon several factors, including its length, and stiffness. Thus, the length and stiffness can be modified according to a particular design, based upon the amount of pressure anticipated in the annulus and/or fluid chamber.

The combination of corrugated portions 228 and 229 effectively carry differential pressures across multiple chambers, so that the chambers are not damaged. Both plastic and elastic deformation are used to limit the overall pressure differential that are experienced within fluid chamber 209.

In this manner, the downstream corrugated portion may be configured to accomplish a safety feature, to prevent the fluid chamber from exceeding a maximum pressure. The downstream corrugated portion may be designed to absorb excess pressure in the fluid chamber using plastic deformation of corrugated portion 229, before the system fails due to pressure overload.

It will be recognized, that a stacked configuration of annular isolators may be used in series, to compensate for higher pressures in the annulus than a single annular isolator could handle.

In accordance with another embodiment of the present invention, a recess or compartment may be provided in expandable tubing 204, in which flowable fluid 212 that is used to form an annular isolator is carried with the expandable tubing when it is run into a borehole. In this embodiment it is desirable for sufficient fluid 212 to be carried with the tubing to form an annular isolator in an oversized and/or washed out borehole. It is generally recognized that the borehole may not only be enlarged, but may have an irregular shape. Specifically, the width may be greater than height or vice versa and the bottom may be filled with cuttings making it flatter than the top. Accordingly, the flexibility of weakened portion 224 of sleeve 205 allows it to conform to such irregular shapes. The volume of fluid 212 carried in expandable tubing 204 should be sufficient to inflate sleeve 205 into contact with such irregular shaped holes so long as it does not exceed the maximum allowable expansion of sleeve 205. It is also desirable that the same systems function properly in a nominal or even undersized borehole. Accordingly, expandable outer sleeve 205 has certain characteristics which make this multifunction capability possible.

Although specific orientations and configurations of annular isolators are illustrated and described within this specification, such embodiments are not intended to limit the scope of the present invention. For example, it will be appreciated that the location, configuration and/or orientation of the components described herein may be altered significantly, within the teachings of the present invention. In many instances, the location and orientation of the components will be driven, at least in part, based upon the pressure differentials experienced in the borehole. Thus, the uphole, and downhole designations described herein may be reversed for example, if the "high pressure side" and the "low pressure side" of the annular isolator are opposite of those described herein.

Figure 6A:
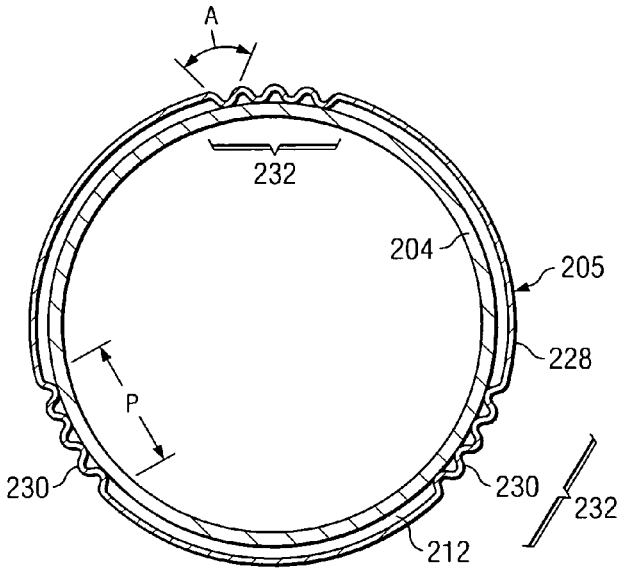
FIGS. 6A-6B illustrate cross-sectional views of a corrugated portion of the annular isolator of FIGS. 4A-4C, in an unexpanded and expanded position, respectively.
Figure 6B:
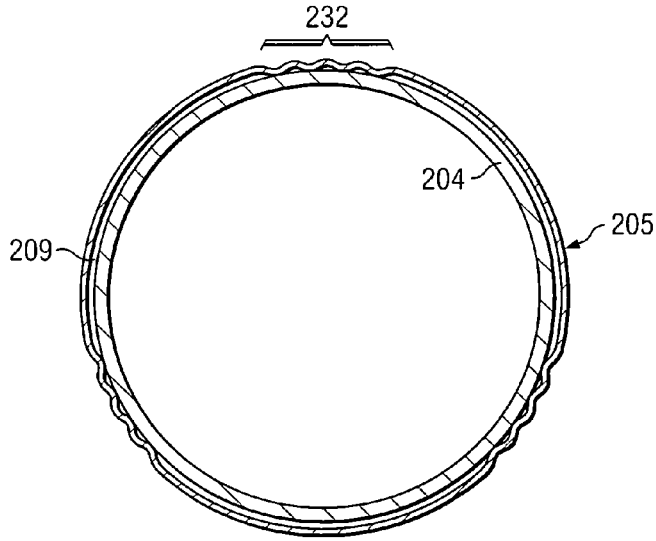

FIGS. 6A and 6B illustrate a cross section of isolator 202 through corrugated portion 228, in more detail. In the illustrated embodiment, corrugated portion 228 includes three corrugated regions 232 having multiple corrugations 230. The starting point of each corrugated region 232 is approximately 120 degrees from the starting point of the adjacent corrugated regions 232. In another embodiment, two corrugated regions may be provided, spaced apart by 180°. FIG. 6A illustrates the relationship between tubing 204 and corrugated portion 228 of sleeve 205, prior to expansion by expansion cone 211. Thus, corrugations 230 of corrugated portion 228 are illustrated in an undeformed state in FIG. 6A. In contrast, FIG. 6B illustrates the relationship, after expansion by expansion cone 211 and the deformation of corrugations 230. As described above, such deformation may be the result of the force of expansion cone 211 and the high pressure of fluid 212 during the expansion process.

As described above, corrugated portion 228 has corrugations 230, which exhibit spring-like qualities to sustain a pressure (e.g., limit or minimize pressure loss) within the fluid chamber, in response to a change in fluid volume. Specifically, as the internal pressure and volume of fluid 212 is decreased by the injection of ambient fluids and associated temperature reduction, corrugations 230 of corrugated portion 228 are biased to return from their slightly deformed shape to substantially their original shape or something similar to their original shape (e.g., accounting for plastic deformation). Thus, corrugations 230, which are biased inward, to return to substantially their original shape of FIG. 6A when the high pressure of fluid 212 is reduced and, consequently, the volume of fluid 212 is reduced. As a result, while the overall volume of fluid in chamber 209 may be reduced, the volume of fluid 212 in weakened portion 224 may be substantially unchanged. In this manner, pressure loss (inside the fluid chamber) due to temperature changes, is minimized, due to the elastic deformation of the corrugated portions. Accordingly, the annular seal provided by the expanded weakened portion 224 may be maintained and the zone or portion of the zone continuously isolated to prevent the production of water and other undesirable fluids.

Each corrugated region 232 has at least five measurable dimensional characteristics, which determine each corrugated section's ability to store elastic energy, in accordance with the teachings of the present invention. A first measurable characteristic is the number of corrugations 230 included in each corrugated region 232. The number of corrugations is the number of waves present in a single corrugated region 232. For example, each corrugated region 232 of corrugated portion 228 has three corrugations. A second measurable characteristic may include the period, illustrated as "P", associated with each corrugated region 232. The period is the angular dimension of the entire corrugated region 232 from beginning to end. For example, each corrugated region 232 may include a period of approximately 15 degrees. A third measurable characteristic may include a corrugation angle, illustrated as "A", which is the angle of decline that each corrugation creates. A fourth measurable characteristic may include a corrugation depth, measured from the top of a corrugation to the bottom of a corrugation. Stated differently, this measurement is analogous to the amplitude of the wave that comprises a single corrugation. A fifth measurable characteristic may include a thickness of the sleeve. The thickness of the sleeve is the difference between the outer diameter of the sleeve and the inner diameter of the sleeve at a location spaced from the corrugations.

Each measurable characteristic described above determines the degree to which a corrugated portion 228 may provide compensation for volumetric and/or pressure changes caused by temperature changes in the material of the compliant chamber. For example, the more corrugations present in a corrugated region 232, the more energy the corrugation may store. Accordingly, FIGS. 6A-6B illustrate merely one example embodiment of a corrugated portion 228. Modifications, additions, or omissions may be made to corrugated portion 228 without departing from the scope of the invention. For example, each corrugated portion 228 may include more or less corrugated regions 232, as is appropriate for the particular application. Additionally, each corrugated region 232 may include more or less corrugations. Other example embodiments of corrugated portions are illustrated in FIGS. 7A-7D.

Figure 7A:
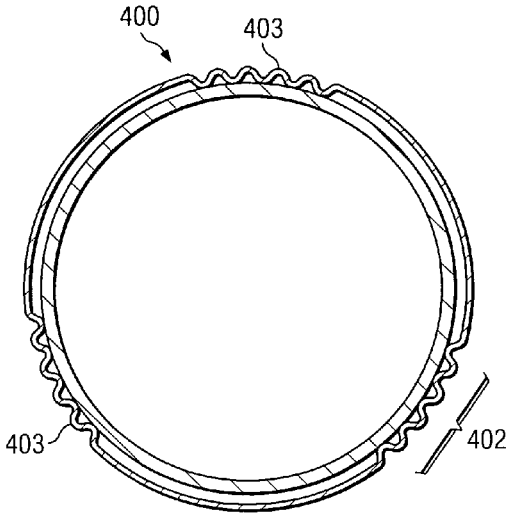
FIGS. 7A-7D illustrate cross-sectional views of further example embodiments of corrugated portions available for storing elastic strain energy in an expandable sleeve.

FIG. 7A illustrates a corrugated portion 400 that includes three corrugated regions 402 of five corrugations 403 each. Corrugated regions 402 are disposed approximately 120 degrees apart, as measured from a beginning point of a corrugated section 402 to a beginning point of an adjacent corrugated section 402. In the illustrated embodiment, the corrugations protrude in a generally inward direction toward the tubing string.

Figure 7B:
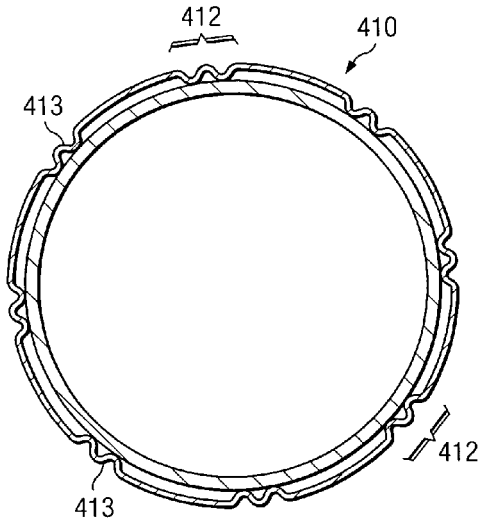

FIG. 7B illustrates a corrugated portion 410 that includes eight corrugated regions 412 of two corrugations 413 each. Corrugated regions 412 are disposed approximately 45 degrees apart, as measured from a beginning point of a corrugated region 412 to a beginning point of an adjacent corrugated region 412. In the illustrated embodiment, the corrugations protrude in a generally inward direction toward the tubing string.

Figure 7C:
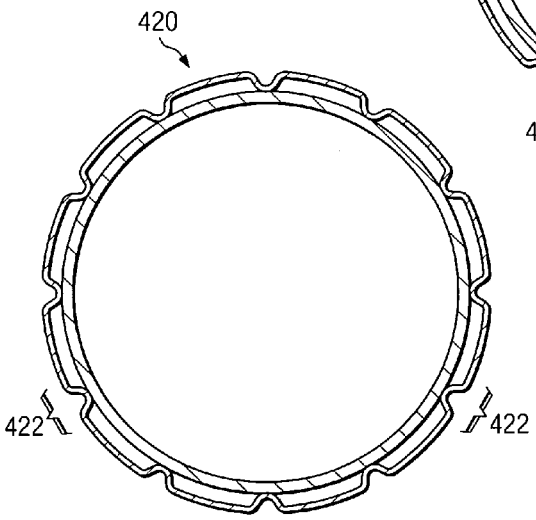

FIG. 7C illustrates a corrugated portion 420 that includes twelve corrugated regions 422 of one corrugation each. Corrugated regions 422 are disposed approximately 30 degrees apart, as measured from a beginning point of a corrugated region 422 to a beginning point of an adjacent corrugated region 422. In the illustrated embodiment, each corrugation protrudes in a generally inward direction toward the tubing string.

Figure 7D:
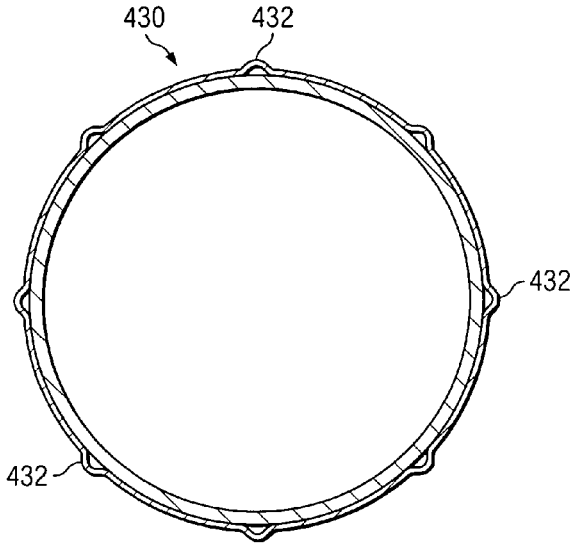

FIG. 7D illustrates a corrugated portion 430 that includes eight corrugated regions 432 of one corrugation each. Corrugated regions 432 are disposed approximately 45 degrees apart, as measured from a beginning point of a corrugated region 432 to a beginning point of the next corrugated region 432.

Another distinguishing characteristic of corrugated portion 430, however, is that each corrugation protrudes in a generally outward direction from the tubing string encased by the sleeve including corrugated portion 430. Because each corrugation protrudes outwardly, the residual volume of fluid after expansion is potentially decreased.

The design or selection of a particular corrugated cross section is based upon two goals of the system. First, it is beneficial to store a substantial amount of elastic strain energy in the system. In other words, it is a design goal to get as much elastic volume change in the fluid chamber as possible, without otherwise risking failure of the system. Second, the design should minimize the residual volume of fluid within the chamber, after the elastic strain energy is expended. The residual volume of fluid is the amount of fluid that remains in the fluid chamber, adjacent the corrugated portion, when the differential between the inside of the chamber and the outside of the chamber approaches zero.

Figure 8:
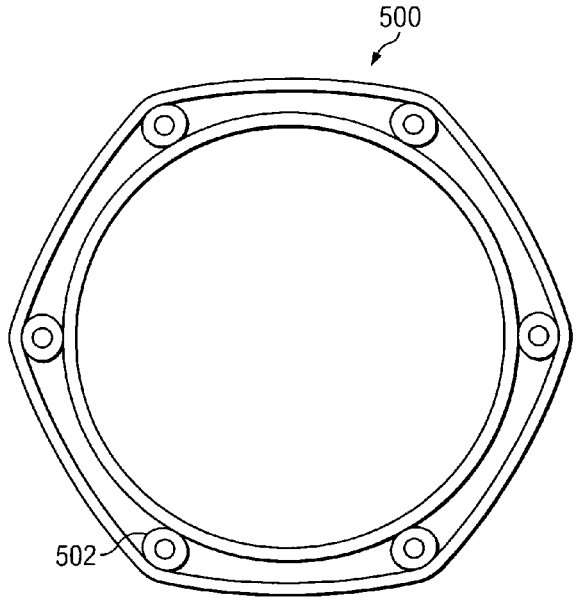
FIG. 8 illustrates a cross-sectional view of an example embodiment of a sleeve that includes radialy elastic members for compensating for volumetric and/or pressure changes caused by temperature changes to an expandable sleeve.

FIG. 8 is a cross-sectional view of an example embodiment of a sleeve 500 that includes radialy elastic members 502 for maintaining fluid pressure (or minimizing fluid pressure loss) that would otherwise occur in response to a decrease in fluid volume. Thus, the radialy elastic members accomplish the same functionality as described above with regard to the corrugated portions of the sleeve. Radialy elastic members 502 may be used as an alternative to or in addition to the corrugations described above. Radialy elastic members 502 may include tubing "springs" inserted between the sleeve and the portion of the tubing string encased by the sleeve. Any members that store elastic strain energy that is biased outward when the member is compressed, may be used within the teachings of the present invention. In the illustrated embodiment, tubular, cylindrical members are illustrated. However, various other configurations are available, including C-shaped members, and elastic solid members or almost any cross-section. Each such section could be used to store elastic energy in a radial direction.

Radialy elastic members 502 may be open ended and rely upon mechanical strength to cause deflection of the sleeve to a non-circular shape. Alternatively, radialy elastic members 502 may be sealed to contain a high pressure gas that may be increased or decreased to alter the amount of deflection exhibited by the outer sleeve.

When radialy elastic members are first deployed, their configuration is cylindrical. After expansion of the expandable tubing, the radialy elastic members are compressed, and the sleeve 500 is deformed, as shown in FIG. 8. In this configuration, elastic strain energy is stored within radialy elastic members 502 that urges the sleeve to deform, in order to compensate for the loss of fluid volume between the tubing and the sleeve. Thus, where temperature fluctuations cause the pressure to decrease, sleeve 500 may be biased to return to substantially its original shape.

As described throughout this specification, the teachings of the present invention provide a method to compensate for thermal changes that occur at or near an annular isolator within a borehole. More specifically, the systems and methods described herein provide a mechanism for maintaining pressure, or minimizes pressure loss within the fluid chamber, that would otherwise result due to a drop in temperature at or near the annular isolator. Several embodiments are provided, and others are available, within the teachings of the present invention.

In accordance with particular embodiments of the present invention, the compensation for temperature change is accomplished by storing elastic strain energy that is biased to sustain pressure (or at least minimize loss of pressure) within the fluid chamber, in response to a change in fluid volume. The corrugated portions and the radialy elastic members accomplish this, by storing elastic strain energy that is biased toward the inside of the fluid chamber.

Thus, the sleeve 205 of the present invention is configured to store elastic strain energy. In one embodiment, this is accomplished by corrugated portions of the sleeve. In another embodiment, this is accomplished by including radialy elastic members within the sleeve. It should be recognized that other methods of storing such elastic energy are available within the teachings of the present invention. For example, a sleeve including a thin-walled portion would be sufficient to store enough elastic strain energy, if the thin-walled portion were long enough. In this embodiment, the thin-walled portion would "stretch" (e.g., elastically deform) when the interior tubing was expanded and/or the fluid in the fluid chamber was otherwise pressurized. In some embodiments, the elastic deformation would also be accompanied by some degree of plastic deformation (e.g., permanent deformation). The elastic deformation would tend to store elastic strain energy that would be biased toward the interior of the fluid chamber.

Although the present invention has been described in several embodiments, a myriad of changes, variations, alterations, transformations, and modifications may be suggested to one skilled in the art, and it is intended that the present invention encompass such changes, variations, alterations, transformations, and modifications as falling within the spirit and scope of the appended claims. For example, many of the above-described embodiments include the use of an expansion cone type of device for expansion of the tubing. However, one of skill in the art will recognize that many of the same advantages may be gained by using other types of expansion tools such as fluid powered expandable bladders or packers. It may also be desirable to use an expandable bladder in addition to a cone type expansion tool. For example, if a good annular isolator is not achieved after expansion with a cone type tool, an expandable bladder may be used to further expand the isolator to achieve sealing contact with a borehole wall. An expandable bladder may also be used for pressure or leak testing an installed tubing string. For example, an expandable bladder may be expanded inside the tubing at the location where an annular isolator has been installed according to one of the embodiments disclosed herein. The tubing may be pressured up to block flow in the tubing itself to allow detection of annular flow past the installed isolator. If excessive leakage is detected, the bladder pressure may be increased to further expand the isolator to better seal against the borehole wall.

As another example, in many of the above described embodiments, the system is illustrated using an expansion tool which travels down hole as it expands expandable tubing and deploys an annular isolator. Each of these systems may operate equally well with an expansion tool which travels up hole during the tubing expansion process. In some embodiments, the locations of various corrugated portions, weakened portions, ports and relief valves may be changed if the direction of travel of the expansion tool is changed. For horizontal boreholes, the term up hole means in the direction of the surface location of a well.

Similarly, while many of the specific preferred embodiments herein have been described with reference to use in open boreholes, similar advantages may be obtained by using the methods and structures described herein to form annular isolators between tubing and casing in cased boreholes. Many of the same methods and approaches may also be used to advantage with production tubing which is not expanded after installation in a borehole, especially in cased wells.

What is claimed is:

1. A system for forming an annular isolator between production tubing and a borehole wall, comprising:

a section of generally cylindrical tubing;

a sleeve disposed around a surface of the tubing, and cooperating with the tubing to form a fluid chamber; and the sleeve including a first portion that is predisposed to expand outwardly under fluid pressure from the fluid chamber, and a second portion being configured such that, when expanded due to fluid pressure, the second portion stores energy that is biased to sustain the fluid pressure within the fluid chamber, in response to a change in fluid volume, and wherein the first portion of the sleeve is weakened with respect to other portions of the sleeve to allow the first portion to expand to a greater extent than the second portion, under equal fluid pressures.

2. The system of claim 1, wherein the second portion comprises an at least partially corrugated region.

3. The system of claim 2, further comprising a first pressure relief valve disposed between the tubing and the sleeve, the first pressure relief valve being configured to release fluid from the fluid chamber when the fluid pressure exceeds a first value.

4. The system of claim 3, wherein the first pressure relief valve is adjacent a first end of the sleeve, and further comprising a second pressure relief valve disposed between the tubing and the sleeve adjacent a second end of the sleeve, and wherein the second pressure relief valve is configured to release fluid from the fluid chamber when the fluid pressure exceeds a second value.

5. The system of claim 4, wherein the first end of the sleeve is downhole from the second end of the sleeve, and wherein the second value is greater than the first value.

6. The system of claim 2, wherein the first portion is configured to expand when the fluid pressure reaches a first value and the corrugated region is configured to expand when the fluid pressure reaches a second value, the second value being greater than the first value.

7. The system of claim 2, wherein:

the borehole has a maximum expected diameter;

the first portion of the sleeve is expandable to approximately the maximum expected diameter without damage to the sleeve; and the fluid chamber is sized to carry a sufficient amount of fluid to expand the first portion of the sleeve to at least the maximum expected diameter.

8. The system of claim 2, wherein the at least partially corrugated region of the second portion of the sleeve comprises a first corrugated region, and further comprising a second corrugated region of the second portion disposed at approximately one hundred and eighty degrees to the first corrugated region.

9. The system of claim 2, wherein the corrugated region includes at least one corrugation that projects outwardly from the sleeve, beyond a circumference of uncorrugated portions of the second portion, when the sleeve is in an unexpanded state.

10. The system of claim 2, wherein the corrugated region includes at least one corrugation that projects inward, toward the tubing, when the sleeve is in an unexpanded state.

11. The system of claim 2, wherein the corrugated region comprises a first corrugated region, and further comprising second and third corrugated regions, the first corrugated region being separated from each of the second and third corrugated regions by approximately one hundred and twenty degrees.

12. The system of claim 2, further comprising an elastomeric sleeve disposed on an outer surface of the sleeve adjacent the first portion of the sleeve.

13. The system of claim 1, wherein the sleeve is formed of a metallic like substance that is selected from the group consisting of ductile iron, stainless steel, alloys, composites, polymer matrix composites, and metal matrix composites.

14. The system of claim 1, further comprising a plurality of radially elastic members disposed between the tubing and the second portion of the sleeve.

15. The system of claim 14, wherein the radially elastic members are pre-charged with a high pressure gas that may be selectively increased or decreased to alter the amount of deflection caused by the radially elastic members on the sleeve.

16. A system for forming an annular isolator between production tubing and a borehole wall, comprising:

a section of generally cylindrical tubing;

a sleeve disposed around a surface of the tubing, and cooperating with the tubing to form a fluid chamber;

the sleeve including a first portion that is predisposed to expand outwardly under fluid pressure from the fluid chamber, and a second portion being configured such that, when expanded due to fluid pressure, the second portion stores energy that is biased to sustain the fluid pressure within the fluid chamber, in response to a change in fluid volume;

wherein the first portion of the sleeve is weakened with respect to other portions of the sleeve to allow the first portion to expand to a greater extent than the second portion, under equal fluid pressures;

wherein the second portion comprises an at least partially corrugated region; and wherein dimensions of the corrugated region are selected to allow for expansion of the corrugated region and deformation of corrugations of the corrugated region when the fluid pressure exceeds a first value, and storage of energy in the deformed corrugations that urges the corrugations toward a substantially undeformed configuration.

17. A method, comprising:

installing a section of expandable tubing in a borehole, the expandable tubing having a sleeve disposed around a surface of the tubing, and cooperating with the tubing to form a fluid chamber;

the sleeve including a first portion that is predisposed to expand outwardly under fluid pressure from the fluid chamber, and a second portion being configured such that, when expanded due to fluid pressure, the second portion stores energy that is biased to sustain the fluid pressure within the chamber, in response to a change in fluid volume; and expanding the tubing using a tool disposed within the tubing.

18. The method of claim 17, further comprising inserting a sufficient amount of fluid into the fluid chamber to inflate the first portion of the sleeve to a maximum expected diameter of the borehole.

19. The method of claim 17, wherein the second portion comprises an at least partially corrugated region.

20. The method of claim 17, further comprising installing an elastomeric jacket on an outer surface of the sleeve.

21. The method of claim 17, wherein a plurality of radially elastic members are disposed between the expandable tubing and the second portion of the sleeve.

22. The method of claim 21, further comprising charging the radially elastic members with a fluid that is selected to determine the amount of deflection caused by the radially elastic members on the sleeve.

23. A system, comprising:

a section of tubing;

a sleeve disposed around a surface of the tubing to form a fluid chamber therebetween; and the sleeve including a first portion that is predisposed to expand substantially under fluid pressure and a second portion that includes a corrugated region that is biased to sustain fluid pressure within the fluid chamber in response to a change in fluid volume, and wherein the first portion of the sleeve is weakened with respect to other portions of the sleeve to allow the first portion to expand to a greater extent than the second portion, under equal fluid pressures.

24. A system, comprising:

a section of tubing;

a sleeve disposed around a surface of the tubing to form a fluid chamber therebetween; and a plurality of radially elastic, generally cylindrical members disposed between the tubing and the sleeve and cooperating with the tubing and the sleeve to deform the sleeve, and wherein the plurality of generally cylindrical members store elastic strain energy that is biased to sustain fluid pressure within the fluid chamber when the plurality of generally cylindrical members are compressed, and wherein the plurality of generally cylindrical members are spaced around the circumference of the tubing at approximately equal angular spacing.

* * * * *